United States Patent [19]

Takayama et al.

[11] Patent Number: 4,587,507

[45] Date of Patent: May 6, 1986

[54] CORE OF A CHOKE COIL COMPRISED OF AMORPHOUS MAGNETIC ALLOY

[75] Inventors: Suguru Takayama, Tokyo; Masao Shigeta, Urayasu, both of Japan

[73] Assignee: TDK Electronics Co., Ltd., Tokyo, Japan

[21] Appl. No.: 443,923

[22] Filed: Nov. 23, 1982

[30] Foreign Application Priority Data

May 23, 1981 [JP] Japan ..... 56-78370

[51] Int. Cl.[4] ..... H01F 17/06

[52] U.S. Cl. ..... 336/178; 336/213; 148/403; 148/31.55; 75/123 B; 75/123 D; 75/123 L

[58] Field of Search ..... 148/31.55, 31.57, 403; 75/123 B, 123 L, 123 D; 336/178, 213

[56] References Cited

U.S. PATENT DOCUMENTS

| | | | |
|---|---|---|---|
| 4,226,619 | 10/1980 | Hatta et al. | 75/123 B |
| 4,265,684 | 5/1981 | Boll | 148/121 |
| 4,321,090 | 3/1982 | Datta et al. | 75/123 B |

FOREIGN PATENT DOCUMENTS

| | | | |
|---|---|---|---|
| 3021536 | 12/1980 | Fed. Rep. of Germany . | |
| 2924280 | 1/1981 | Fed. Rep. of Germany . | |
| 56-72153 | 6/1981 | Japan . | |
| 56-69360 | 6/1981 | Japan | 148/31.55 |
| 57-202709 | 12/1982 | Japan | 148/31.55 |

OTHER PUBLICATIONS

"Amorphous Materials Having Low Loss at High Frequency" Proc. 4th Int. Conf. on Rapidly Quenched Metals, pp. 953–956, Sendai 1981.

*Primary Examiner*—John P. Sheehan
*Attorney, Agent, or Firm*—Armstrong, Nikaido, Marmelstein & Kubovcik

[57] ABSTRACT

Conventionally, silicon steel strips and ferrite cores have been used as the core of a choke coil. These strips and the like have not yet been replaced with amorphous alloy because in the known amorphous magnetic alloy the pre-magnetization characteristic, the amount of heat generated, and the secular change are poor.

The present invention proposes a core of a choke coil which consists of a coiled thin strip of an amorphous alloy, and has at least one cut air gap, the coiled regions of the thin strip being bound to one another at at least in the neighborhood of said at least one cut air gap, and said amorphous magnetic alloy is essentially comprised of the following composition, $Fe_xMn_y(Si_pB_qP_rC_s)_z$, wherein $x+y+z$ is 100 atomic % based on all of the elements, y is from 0.001 to 10 atomic %, z is from 21 to 25.5 atomic %, $p+q+r+s$ is atomic % 1, p is from 0.40 to 0.75, r is fro 0.0001 to 0.05, the ratio s/q is from 0.03 to 0.4, and z is $z \leqq 50p+1$, $z \leqq 10p+19$, $z \geqq 30p+2$, and $z \geqq 13p+13.7$.

13 Claims, 7 Drawing Figures

CORE OF A CHOKE COIL COMPRISED OF AMORPHOUS MAGNETIC ALLOY

The present invention relates to a core of a choke coil comprised of an amorphous magnetic alloy.

A choke coil is used in an inverter, such as a switching inverter and a thyristor inverter. It is also used in a direct-current source so as to eliminate ripples in a voltage which has been rectified or so as to eliminate a switching surge.

A choke circuit is described with reference to: FIG. 1, which shows a single forward converter circuit; FIG. 2, which shows the secondary circuit voltage of a power transformer; and FIG. 3, which shows the current conducted through a power inductor.

In FIG. 1, PT denotes a power transformer, the secondary circuit voltage of which is denoted by $E_S$. $D_1$ is a switching diode, and $D_2$ is a diode which, when the switching diode $D_1$ is turned off, discharges the current stored in a choke coil CH. The secondary circuit voltage $E_S$ of the power transformer PT is rectified by the switching diode $D_1$ and smoothed by the diode $D_2$ and the capacitor C so that the current conducted through the choke coil CH is, as is shown in FIG. 3, a direct current having ripples. The ratio of $$I_r/I_L \times 100$$

is referred to as the current ripple percentage, wherein $I_L$ and $I_r$ are the direct bias current and ripples, respectively. A function of the choke coil CH is to eliminate ripples.

Silicon steel and ferrite have mainly been used as the core of a choke coil.

F. E. Luborsky reported in G.E. Rep. No. 77 CRD276(1978) that an amorphous magnetic alloy having the composition of $Fe_{78}B_{12}Si_{10}$ has magnetic properties which make it adaptable for use as the core of a power transformer.

F. E. Luborsky also reported in IEEE Vol. MAG-16 No. 4, July 1980 several magnetic and physical properties of an amorphous magnetic alloy having the Fe content of from 72 atomic % to 92 atomic %, the Si content of from 0 to 15 atomic %, and the B content of from 6 atomic % to 28 atomic %.

Kenji Narita reported several magnetic and physical properties of an amorphous magnetic alloy in a technical report of a magnetic material-research meeting which was held by Japan Society for Electricity on July 6, 1979. The amorphous magnetic alloy reported by Kenji Narita has the Fe content of from 67 atomic % to 86 atomic %, the Si content of from 0 to 22 atomic %, and the B content of from 5 atomic % to 26 atomic %. Secular change in the permeability of an amorphous magnetic alloy having the composition of $Fe_{75}Si_{13}B_{12}$ is reported in the technical report mentioned above.

J. Hoselitz reported in J. 3M 20 (1980) pp 201–206 several magnetic and physical properties of an amorphous magnetic alloy having the composition of $(Fe_{1-x})_{1-y}B_y$, wherein x and y are in the ranges of $0.02 \leqq x \leqq 0.18$, and $0.06 \leqq y \leqq 0.24$, respectively.

The magnetic properties mentioned above are for example the saturation magnetization ($B_s$), the saturation magnetostriction ($\lambda_s$), the coercive force ($H_c$), the Curie temperature ($T_c$), and the like. In addition, the physical properties mentioned above are the crystallization temperature, the density and adaptability, for forming a thin strip. A power transformer is used without the application of a direct bias current, and, therefore, magnetic properties required in an amorphous magnetic alloy adaptable for use as the core of a power transformer are different from those required in an amorphous magnetic alloy adaptable for use as a choke coil. When a direct bias current is conducted through a choke coil, the magnetic properties, especially the permeability, of a thin strip of an amorphous magnetic alloy tend to deteriorate. When the permeability deteriorates, the inductance of the choke coil deteriorates accordingly, with the result that the choke coil cannot effectively eliminate ripples or a switching surge. The inductance of a choke coil energized by a direct bias current is hereinafter referred to as the pre-magnetization characteristic.

In addition to the above-mentioned pre-magnetization characteristic, the amount of heat generated is related to the power loss of a thin strip of an amorphous magnetic alloy and is important.

A thin strip of an amorphous magnetic alloy of which the core of a choke coil is made undergoes variance of the magnetic field, which vairance occurs due to ripples, with the result that the power loss mentioned above is generated.

The pre-magnetization characteristic is influenced by forming an air gap in the magnetic path of the core of a choke coil, so that the inductance is generally low but does not tend to decrease with the increase in the bias current. Desirably, the pre-magnetization characteristic is such that high inductance is stably obtained up to a high bias current.

If a thin strip of magnetic material is used for manufacturing of the core of a choke coil, a thin strip of magnetic material is subjected to the following winding in the form of for example a coil, heat treatment, for example, the stress-relief annealing; bonding of the wound this strip of magnetic material; and, cutting so as to form at least one air gap in the magnetic path of the core of a choke coil. The bonding and cutting mentioned above tend to deteriorate the pre-magnetization characteristic and especially the amount of heat generated. Especially if the metallic elements of an amorphous magnetic alloy are mainly iron, this alloy has high saturation-magnetostriction and thus its deterioration in the amount of heat generated is serious.

In previous technical reports, in which the core of a power transformer comprised of an amorphous magnetic alloy is disclosed, the power loss of a core which is wound in a toroidal form and which is heat treated, for example, stress-relief annealed, is measured. In the words, the previous technical reports mentioned above do not contemplate how the magnetic properties are deteriorated by stress which is generated due to cutting or bonding.

In addition to previous proposals for resing the amorphous magnetic alloy for a pulse transformer, a current sousor, an electric motor, and a magnetic amplifier, U.S. Pat. No. 4,265,684 proposes to use an amorphous magnetic alloy for a magnetic core having an air gap. This air gap is formed by selectively converting an amorphous magnetic alloy to a crystalline state, and, therefore the air gap is not formed by cutting.

The magnetic properties of an amorphous magnetic alloy are liable to deteriorate over a long period of time when the amorphous magnetic alloy is used, for example, as a power transformer or a magnetic head. That is, the permeability and watt loss of a thin strip of an amorphous magnetic alloy are liable to deteriorate gradually over a long period of time. Deterioration of the pre-magnetization chracteristic and deterioration of the amount of heat generated are hereinafter referred to as a secular change in the pre-magnetization characteristic and a secular change in the amount of heat generated, respectively, and are collectively referred to as a secular change.

The pre-magnetization characteristic, the amount of heat generated, and the secular change in the known thin strips of an amorphous magnetic alloy are insufficient properties for the strips to be adaptable for use as the core of a choke coil, which core has a cut air gap. Therefore, these known thin strips cannot be used to replace conventional silicon steel strips and ferrite core.

It is an object of the present invention to provide a core of choke coil consisting of an amorphous magnetic alloy which is adaptable for use in electrical machinery and apparatuses in which a current having a relatively high frequency, e.g., from commecial frequency to 500 KHz, is converted into a direct current or a current having a relatively low desired frequency by means of the amorphous magnetic alloy core so as to eliminate ripples, a switching surge, or any undesirable high-frequency current which is periodically or consecutively seperimposed on the alternating or direct current and which is transmitted from a current source or is generated in the circuit of the electric machinery or apparatuses.

The amorphous magnetic alloy core of the present invention consists of a coiled thin strip of an amorphous magnetic alloy, and has at least one cut air gap, the coiled regions of the strip being bound to one another at at least in the neighborhood of said at least one cut air gap, and said amorphous magnetic alloy partially contains precipitated fine crystals and is essentially comprised of the following composition: $Fe_xMn_y(Si_pB_qP_rC_s)_z$, wherein $x+y+z$ is 100 atomic % based on all of the elements, y is from 0.001 to 10 atomic %, z is from 21 to 25.5 atomic %, $p+q+r+s$ is 1, p is from 0.40 to 0.75, r is from 0.0001 to 0.05, the ratio s/q is from 0.03 to 0.4, and z is $z \leqq 50p+1$, $z \leqq 10p+19$, $z \geqq 30p+2$, and $z \geqq 13p+13.7$.

It is preferred that: z is from 22.5 to 24.5 atomic %; p is from 0.55 to 0.72; r is from 0.0001 to 0.05; the ratio s/q is from 0.03 to 0.4; $z \leqq 10p+18$; $z \leqq -25p+42$; $z \geqq 50p-12$; and, $z \geqq 10p+16$.

Usually, an amorphous alloy is distinguished from a conventional crystalline alloy in that in X-ray diffraction of the amorphous alloy, there is no diffraction of the crystal lattices. The absence of diffraction of the crystal lattices is usually referred to as a halo pattern. The thin strip of an amorphous magnetic alloy according to the present invention is distinguished from a conventional amorphous alloy by the presence of precipitated fine crystals in the amorphous phases.

The diffraction specter of the thin strip of an amorphous magnetic alloy of the present invention shows a halo pattern in the amorphous phases and a Debye-Scherrer ring of the precipitated fine crystals. Judging from the diameter and width of the Debye-Scherrer ring, the precipitated crystals are very fine and have an average grain diameter of from 10 to 1000 Å (from 1 to 100 nm). The condition of X-ray diffraction is usually power of 3 KW (X-ray tube-voltage and current being 30 KV and 100 mA, respectively).

The precipitated fine crystals are different from the crystals in an incomplete amorphous alloy, in which crystals are formed due to incomplete vitrification. The precipitated fine crystals are intentionally formed by means of a heat treatment and are very fine and induce magnetic anisotropy while the crystals formed due to incomplete vitrification are coarse and do not induce magnetic anisotropy. The precipitated fine crystals contribute to improvement of the pre-magnetization characteristic, the amount of heat generated, and the secular change.

According to an experiment of the present inventors, the power loss ($P_L$) and the amount of heat generated were measured with regard to the core comprised of a thin strip of the known amorphous alloy, i.e., $Fe_{81}(Si_{0.1}B_{0.9})_{19}$, and the core comprised of a thin strip of $Fe_{75.97}Mn_{0.03}(Si_{0.6}B_{0.386}P_{0.0003}C_{0.0137})_{24.0}$ which had the ratio s/q of 0.035. The power loss ($P_L$) was measured at the frequency of 50 kHz and magnetic flux density $B_{peak\text{-}peak}$ of 2 kG. The amount of heat generated was measured by the method described hereinbelow. The measuring results are given in Table 1.

TABLE 1

| Composition | Heat Treatment | After Heat Treatment $P_L$ (mW/cm³) | After Bonding by Resinous Material Followed by Cutting $P_L$ (mW/cm³) | Amount of Heat Generated (°C.) |
|---|---|---|---|---|
| $Fe_{81}(Si_{0.1}B_{0.9})_{19}$ | 440° C. × 30 minutes | 30 | 350 | 45 |
| $Fe_{75.97}Mn_{0.03}(Si_{0.6}B_{0.386}P_{0.0003}C_{0.0137})_{24.0}$ | 440° C. × 30 minutes | 80 | 150 | 20 |

As is apparent from Table 1, above, the deterioration degree of the power loss due to the bonding and cutting considerably depends on the composition of amorphous magnetic alloy. The present inventors who discovered this fact extensively studied composition of the amorphous magnetic alloy and then completed the present invention.

The composition of the thin strip of an amorphous magnetic alloy is now explained.

At least one transition element, but is not Mn, may partly replace Fe. The at least one transition element, which is hereinafter referred to as M, is selected from the 4s-transition elements (Sc-Zn), the 5s-transition elements (Y-Cd), the 6s-transition elements (La-Hg), and elements having atomic numbers equal to or greater than Ac. M may be Co, Ni, Cr, Cu, Mo, Nb, Ti, W, V, Zr, Ta, T, or a rare earth element.

At least one metalloid element which may be Al, Be, Ge, Sb, or In may partly replace Si, B, P, or C.

When y, i.e., the content of Mn based on the total number of elements, is less than 0.001 atomic %, the secular change in the pre-magnetization characteristic is great, and, in addition, it becomes difficult to form the precipitated fine crystals by means of a heat treatment. When y is more than 10 atomic %, the secular change is great, the pre-magnetization characteristic is deteriorated, and the formation of a thin strip becomes difficult. It is preferred that y be in the range of from 0.1 to 5 atomic %.

When M replaces Fe at an amount exceeding 10 atomic %, the amount of heat generated is great and the pre-magnetization characteristic is deteriorated. It is preferred that the replacing amount be not more than 5 atomic %.

When z, i.e., the contents of the metalloid elements based on the total number of elements, is less than 21.0 atomic % or more than 25.5 atomic %, the amount of heat generated is great. In addition, when z is less than 21.0 atomic %, certain disadvantages result. First, the formation of a thin strip of an amorphous magnetic alloy becomes difficult. Second, the surface roughness of the thin strip is increased so that the packing density of the resultant core is disadvantageously increased. Third, it becomes difficult to form precipitated fine crystals by means of a heat treatment. Fourth, the crystallization temperature is disadvantageously lowered. And fifth, the corrosion resistance of the thin strip of an amorphous magnetic alloy when it is exposed to air is deteriorated. With the result that the strip is liable to become stained.

The content of each metalloid element is determined for two reasons, one reason being that when p, i.e., the content of Si is less than 0.4 or more than 0.75, the amount of heat generated is great and the pre-magnetization characteristic is impaired and the other reason being that when p is less than 0.4, the secular change becomes great.

The relationship between p and z is explained with reference to FIG. 4.

Figure 1:
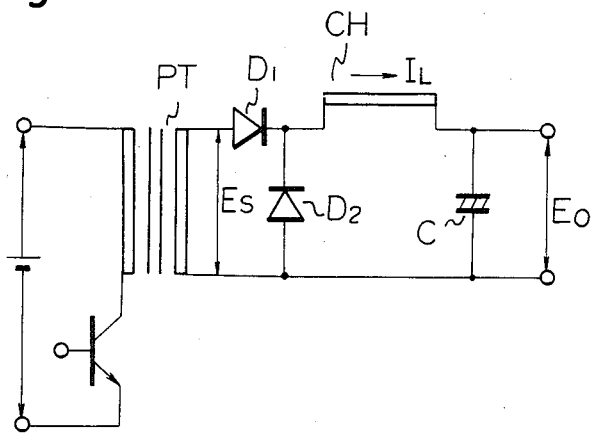
FIG. 1 shows a single forward converter circuit.
Figure 2:
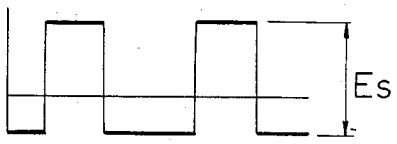
FIG. 2 shows the secondary circuit voltage of a power transformer.
Figure 3:
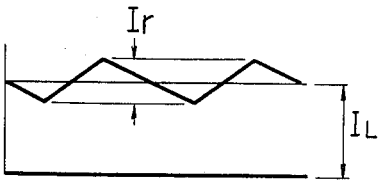
FIG. 3 shows the current conducted through a power transformer.
Figure 4:
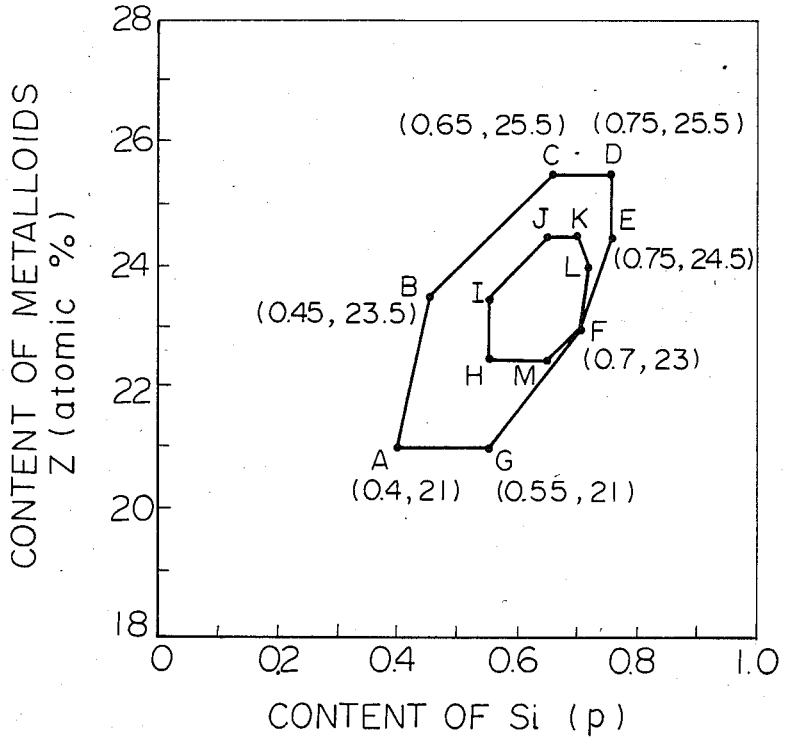
FIG. 4 is a graph illustrating the relationship between p and z of the thin strip of an amorphous magnetic alloy according to the present invention.

In FIG. 4, the line AG and the line CD correspond to the minimum z and maximum z, respectively.

The line AB is expressed by $z=50p+1$, and the line BC is expressed by $z=10p+19$. When z exceeds $50p+1$ or $10p+19$, the amount of heat generated, the pre-magnetization characteristic, and the secular change are all unsatisfactory. When z is $30p+2$, i.e., the line EF, or $13p+13.7$, i.e., the line FG, the amount of heat generated is great and vitrification by rapid-quenching becomes difficult. Furthermore, it becomes difficult to precipitate fine crystals by means of a heat treatment. When p is more than 0.75, the formation of a thin strip is difficult and the pre-magnetization characteristic is unsatisfactory.

It is preferred that p and z fall within the lines HI, IJ, JK, KL, LF, FM, and MH.

The points H, I, J, K, L, M, and N indicate the following:

H(P=0.55, and z=22.5);
I(p=0.55, and z=23.5);
J(p=0.65, and z=24.5);
K(p=0.7, and z=24.5);
L(p=0.72, and z=24);
F(p=0.7, and z=23); and,
M(p=0.65, and z=22.5).

In addition, the above mentioned lines correspond the following:

HI~p=0.55;
1J~z=10p+18;
JK~z=24.5;
KL~z=−25p+42;
LF~z=50p−12;
FM~z=10p+16; and,
MH~z=22.5.

When r is less than 0.0001, the secular change is great. When r is more than 0.05, the amount of heat generated is great and the pre-magnetization characteristic is deteriorated. It is preferred that r be in the range of from 0.0001 to 0.01.

In the present invention, not the absolute contents but the ratio s/q is critical. When the ratio s/q is less than 0.03, the amount of heat generated is great and the pre-magnetization characteristic and the secular change are great. When the ratio s/q is more than 0.4, the formation of a thin strip is difficult and the amount of heat generated is great. Therefore, it is preferred that the ratio s/q be from 0.03 to 0.4. It is also preferred that s be in the range of from 0.007 to 0.229 and that q be in the range of from 0.143 to 0.571.

When X replaces Si, B, P, and C more than 10 atomic %, the pre-magnetization characteristic is deteriorated.

In an embodiment of the present invention, magnetic anisotropy is induced in the strip in a predetermined direction parallel to the sheet surface. The magnetic anisotropy is preferably one-axis magnetic anisotropy and is induced along the longitudinal axis of the strip or along a slanted angle with respect to the longitudinal axis mentioned above. Due to the magnetic anisotropy, the pre-magnetization characteristic is improved and the amount of heat generated is decreased in comparison with a conventional thin strip of an amorphous magnetic alloy. Such magnetic anisotropy can be induced by the formation of precipitated fine crystals. That is, when a virtually completely vitrified thin strip of an amorphous magnetic alloy is heat-treated so as to form precipitated fine crystals, one-axis magnetic anisotropy is induced along the longitudinal axis of the strip being heat-treated even if a magnetic field is not imparted to the strip being heat-treated. When a magnetic field is imparted to a virtually completely vitrified thin strip which is being heat-treated, not only is the magnetic anisotropy enhanced but, also, the direction of magnetic anisotropy can be adjusted.

The magnetic anisotropy may be in the axial direction of the coiled thin strip of amorphous magnetic alloy, i.e., along the central axis of the coil. Magnetic anisotropy can be induced in the axial direction of the coiled thin strip by imparting a magnetic field to the coiled thin strip in the axial direction thereof, which magnetic field can be imparted with a pair of magnets. The magnetic anisotropy may be induced in a direction which is slanted with respect to the axial direction of a coiled thin strip of an amorphous magnetic alloy. Magnetic anisotropy can be induced in an amorphous magnetic alloy core not only by imparting a magnetic field to or by heat-treating a thin strip of amorphous magnetic alloy but also by heat-treating the core and/or imparting a magnetic field to the core, the magnetic field being imparted with a pair of magnets and/or a magnetizing coil. The magnetizing coil may be directly wound around the core. Alternatively, it may be disposed near the core so that the core is subjected to the magnetic field. In such a case, the magnetizing coil may also be used to heat, due to the current passing through the magnetizing coil, the thin strip of an amorphous alloy to a temperature at which fine crystals are precipitated, and, further, the magnetic field produced by the current magnetizes the thin strip. For example, if a coiled thin strip of amorphous magnetic alloy is interposed between a pair of magnets and a magnetizing coil is wound around one section of it, magnetic anisotropy is induced in a direction which is slanted with respect to the axial line of the coiled thin strip of amorphous magnetic alloy.

In another embodiment of the present invention, the thin strip has a thickness of from approximately 10 μm to approximately 100 μm and a width of from approximately 1 mm to approximately 500 mm.

The amorphous magnetic alloy core of the present invention consists of a coiled thin strip of an amorphous magnetic alloy. Thus, the core is a coiled core not a laminated core. It is a coiled core because in the laminated core the magnetic path does not coincide with the easy direction of magnetization of a core, with the result that the amount of heat generated is great. In addition, the pre-magnetization characteristic is appreciably deteriorated during the manufacture of a laminated core. In the present invention, a thin strip of an amorphous magnetic alloy is coiled around a coil frame or form which may have not only a cylindrical or rectangular shape but also any desirable shape. The coil frame or form may be made of ceramic, glass, resin, or metal. One end of the coiled thin strip may be fixed to another part of the strip by any appropriate means, such as bonding, welding, taping, or caulking, and insulating material may be sandwiched between the opposed surface parts of the coiled thin strip. The coil frame or form may be used as a member for preventing distortion or deformation of the coiled thin strip. Alternatively, resinous material may be molded around the coiled thin strip.

In an embodiment of the present invention, the core comprises core members, each of which consists of a thin strip of an amorphous magnetic alloy. The core members do not have a cylindrical shape; rather, they have a predetermined shape, such as a U, C, I, L, E shape or the like, formed by cutting a coiled thin strip of an amorphous magnetic alloy. The above-mentioned shapes of the core members may be optionally combined so as to form the amorphous magnetic alloy core of the present invention. Such a combination, which is known in the manufacture of transformers, can be applied in the manufacture of choke coils. Possible combinations of the core members are a combination of several I, U, C, or E-shaped core members and a combination of an E-shaped core member and several I-shaped core members.

Before the coiled thin strip of an amorphous magnetic alloy is cut into a core member having a predetermined shape, or before the coiled thin strip of an amorphous magnetic alloy is provided with an at least one cut air gap, the coiled thin strip is bound in such a manner that at least portions to be cut and its neighbouring portions are bound with each other. Usually, the entire coiled thin strip of an amorphous magnetic alloy is subjected to dipping or moulding of resinous material, so that the interior parts thereof are impregenated with a resinous material or the like from an exposed section of the coiled thin strip. Alternatively, a coiled thin strip may be caulked so as to make it more firm it before is cut.

In the present invention, the core comprises at least one cut air gap in the magnetic path. Usually, this gap is from 0.001 to 0.05 times the length of the magnetic path. It can be formed by slitting a coiled thin strip of amorphous magnetic alloy. Alternatively, the gaps can be formed between the combined core members. That is, when the core members which are manufactured by cutting a coiled thin strip are combined, one or more ends of each of the core members are positioned so as to confront one another, with at least one cut air gap being left therebetween. Usually, the at least one cut air gap is filled with a spacer made of, for example, polyethylene terephthalate. Not only one cut air gap but also a pair of cut air gaps may be formed.

A heat treatment for precipitating fine crystals may be carried out in the ambient air, an inert gas, or a non-oxidizing atmosphere, and if a magnetic field is desired in a thin strip or a coiled thin strip of an amorphous magnetic alloy, the magnetic field can have intensity of, for example, 100 Oe. The thin strip of an amorphous magnetic alloy may be subjected to tension during the heat treatment for precipitating fine crystals. Stress relief-annealing of a coiled thin strip of an amorphous magnetic alloy may also be carried out.

In order to complete a choke coil, such processes as winding, resin-molding, curing, etc., must be carried out. Since these processes are known in the manufacture of a choke coil having a ferrite- or silicon-steel core, they are not described herein.

The present invention is hereinafter described with reference to the following examples.

EXAMPLE 1

Two 8 mm-wide and 30 μm-thick thin strips of an amorphous magnetic alloy, hereinafter referred to as thin strips, were formed by means of a known liquid rapid-cooling method. One of the thin strips had the composition of the present invention, i.e. $Fe_{76.7}Mn_{0.3}(Si_{0.609}B_{0.33}P_{0.004}C_{0.057})_{23.7}$, wherein the ratio s/q was 0.17. The other thin strip had a composition which fell outside the present invention i.e. $Fe_{74}(Si_{0.5}B_{0.5})_{26}$, wherein the ratio s/q was zero.

The two thin strips were virtually completely vitrified. In other words, they were virtually completely amorphous.

Each of the strips was cut into five pieces. One of the five pieces was not heat-treated. The other four pieces were heat-treated under the conditions given in Table 2.

TABLE 2

| Examples | | Heat Treatment | X-ray Diffraction |
|---|---|---|---|
| Comparative Examples | A-1 | — | Halo Pattern Only |
| | A-2 | 250° C., 60 minutes | Halo Pattern Only |
| Invention | A-3 | 400° C., 30 minutes | Halo Pattern + Diffraction Peak |
| | A-4 | 440° C., 20 minutes | Halo Pattern + Diffraction Peak |
| Comparative Examples | A-5 | 500° C., 10 minutes | Diffraction Peak Only |
| | B-1 | — | Halo Pattern Only |
| | B-2 | 250° C., 60 minutes | Halo Pattern Only |
| | B-3 | 400° C., 30 minutes | Halo Pattern + Diffraction Peak |
| | B-4 | 440° C., 20 minutes | Halo Pattern + Diffraction Peak |

TABLE 2-continued

| Examples | | Heat Treatment | X-ray Diffraction |
|---|---|---|---|
| | B-5 | 500° C., 10 minutes | Diffraction Peak Only |

Ten samples, i.e., the two non-heat-treated pieces of the two thin strips specimen and the eight heat-treated pieces of the two thin strips, were subjected to X-ray diffraction under the conditions specified hereinabove.

As is apparent from Table 2, the virtually completely vitrified thin strips were continuously converted to completely crystalline thin strips in accordance with an increase in the heat treatment temperature.

EXAMPLE 2

Figure 5:
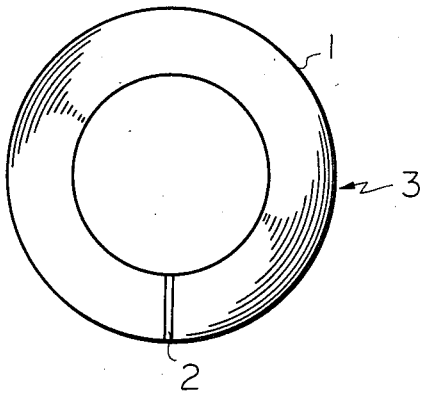
FIG. 5 is a schematic plan view of a core.

Two thin strips identical to those in Example 1 were formed, and each of then was cut into five pieces. The ten pieces were each coiled into a toroidal coil having an inner diameter of 19 mm, an outer diameter of 31 mm, and a width of 8 mm. Thus, ten coiled thin strips of an amorphous alloy were obtained. The thin coiled strips of amorphous alloy are hereinafter referred to as coils. Two of the coils were not heat-treated, and the other coils were heat-treated in the same manner as in Example 1. Epoxy resinous material was molded around each of the ten coils and was then cured. Subsequently, the coils were slit so as to form a cut air gap 2, shown in FIG. 5, in which only one coil 1 is shown. The cut air gap 2 had a thickness of 1 mm and was formed in the magnetic path.

The coils were provided with a winding so that the inductance (L) was 30 μH, and the pre-magnetization characteristic given in Table 3 was evaluated by measuring the current at which the inductance (L) was decreased from 30 μH to 20 μH. It was concluded from the results that if the current measured is high, the pre-magnetization characteristic is good. The amount of the heat generated, given in Table 2, was evaluated by measuring the temperature of the coils.

A thermocouple was fixed to a part of each coil and a current of 20A was conducted through each of the coils. While the current was being conducted through each of the coils, the increase in temperature was measured.

The manner in which the secular change, given in Table 3, was measured is now described. The coils were held in a constant temperature bath (120° C.) for a period of 1,000 hours. During this period, the current and increase in temperature were measured. The symbol o in Table 3 indicates that there was a slight change in the current and a slight increase in temperature within the measuring error, and, thus, that the secular change was excellent. The symbol x in Table 3 indicates that there was a change in the current and an increase in temperature exceeding 10% and, thus, that the secular change was unsatisfactory. The symbol Δ in Table 3 indicates that the above-mentioned change was less than 10%.

TABLE 3

| Coils | | Increase in Temperature | Pre-magnetization Characteristic | Secular Change |
|---|---|---|---|---|
| Comparative Example | A'-1 | 80° C. | 5 A | x |
| | A'-2 | 50° C. | 15 A | Δ |
| Invention | A'-3 | 20° C. | 25 A | o |
| | A'-4 | 20° C. | 26 A | o |
| Comparative Example | A'-5 | more than 80° C. | 5 A | o |
| | B'-1 | 80° C. | 5 A | x |
| | B'-2 | 50° C. | 15 A | Δ |
| | B'-3 | 30° C. | 20 A | Δ |
| | B'-4 | 30° C. | 20 A | Δ |
| | B'-5 | more than 80° C. | 5 A | o |

From a comparison of the coils A'-1 through A'-5 and B'-1 through B'-5 in Table 2 l and Samples A-1 through A-5 and B-1 through B-5 in Table 1, respectively, it is apparent that when thin strips of amorphous magnetic alloy partially contain precipitated fine crystals, and that when the composition of amorphous magnetic alloy lies within the scope of the present invention, the amount of heat generated, the pre-magnetization characteristic, and the secular change are all excellent.

EXAMPLE 3

The procedure of Example 2 was repeated except for the following: (1) Thin strips having the composition $$Fe_{99-z}Mn_{1.0}\left(Si_pB_{\frac{0.999-p}{1.2}}P_{0.001}C_{\frac{0.999-p}{6}}\right)_z,$$

wherein the ratio s/q was 0.2 and "p" and "z" were varied, were used; (2) thin strips, not coils, were heat-treated within a temperature range of from 350° C. to 480° C.

Figure 6:
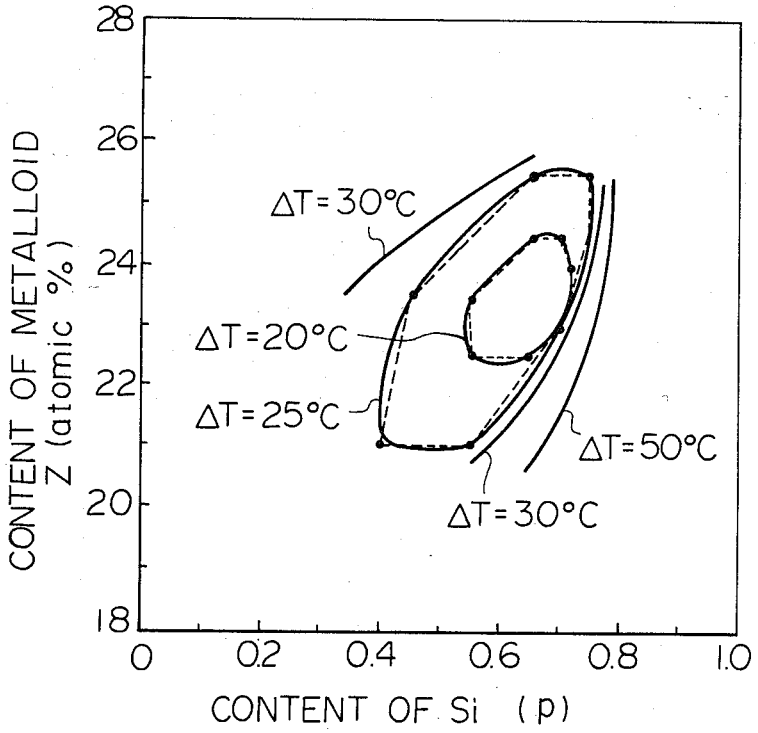
FIG. 6 is a graph illustrating how the temperature margin described below is influenced by p and z.

The increase in temperature of the coils was measured and is represented in FIG. 6 by the symbol ΔT. As is apparent from FIG. 6, the amount of heat generated is low within the outer dot-lines and is very low within the inner dot-lines. In addition, every thin strip partially contained precipitated fine crystals. Two broken lines of FIG. 6 indicate p and z of the present invention and a preferable embodiment.

Figure 7:
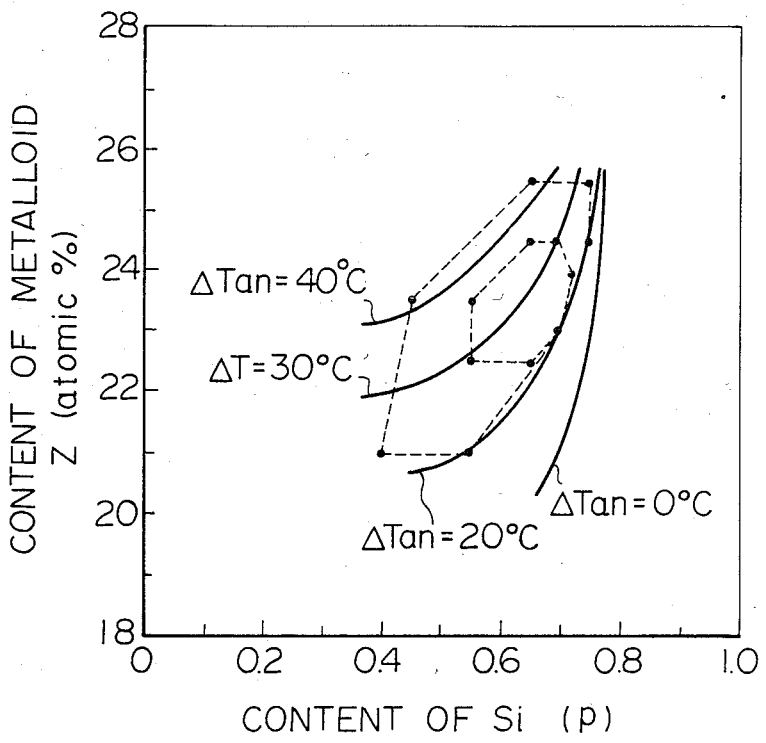
FIG. 7 is a graph similar to FIG. 6.

In the present example, the difference ΔT an in the maximum and minimum heat treatment temperatures at which the fine crystals are precipitated was investigated under a condition in which the heat treatment time was 40 minutes. From FIG. 7, which shows ΔT an, it will be apparent that when z is outside the outer dot-lines, the difference ΔT an is great, and, thus, the condition for forming precipitated fine crystals is not very limited.

EXAMPLE 4

The procedure of Example 2 was repeated except that the composition of the thin strips was as given in Table 4, and, further, the difference ΔT an at the maximum and minimum heat treatment temperatures required for keeping the increase in temperature to 25° C. or less was investigated.

TABLE 4

| Coils | Composition | ΔTan | Pre-magnetization Characteristic | Secular Change |
|---|---|---|---|---|
| C-1 (Comparative Example) | $Fe_{75.5}(Si_{0.7}B_{0.278}P_{0.002}C_{0.02})_{24.5}$ | 10° C. | 15 A | Δ |

TABLE 4-continued

| Coils | Composition | ΔTan | Pre-magnetization Characteristic | Secular Change |
|---|---|---|---|---|
| C-2 (Invention) | $Fe_{75.4}Mn_{0.1}(Si_{0.7}B_{0.278}P_{0.002}C_{0.02})_{24.5}$ | 20° C. | 20 A | o |
| C-3 (Invention) | $Fe_{75.3}Mn_{0.2}(Si_{0.7}B_{0.278}P_{0.002}C_{0.02})_{24.5}$ | 30° C. | 25 A | o |
| C-4 (Invention) | $Fe_{75}Mn_{0.5}(Si_{0.7}B_{0.278}P_{0.002}C_{0.02})_{24.5}$ | 30° C. | 25 A | o |
| C-5 (Invention) | $Fe_{74.5}Mn_{1}(Si_{0.7}B_{0.278}P_{0.002}C_{0.02})_{24.5}$ | 35° C. | 26 A | o |
| C-6 (Invention) | $Fe_{73.5}Mn_{2}(Si_{0.7}B_{0.278}P_{0.002}C_{0.02})_{24.5}$ | 35° C. | 26 A | o |
| C-7 (Invention) | $Fe_{70.5}Mn_{5}(Si_{0.7}B_{0.278}P_{0.002}C_{0.02})_{24.5}$ | 30° C. | 24 A | o |
| C-8 (Invention) | $Fe_{65.5}Mn_{10}(Si_{0.7}B_{0.278}P_{0.002}C_{0.02})_{24.5}$ | 20° C. | 20 A | o |

Note:
s/q = 0.072

As is apparent from Table 4, when the manganese content is zero, ΔT an is too narrow to stably generate a small amount of heat. In addition, the pre-magnetization characteristic and the secular change are unsatisfactory.

All of the thin strips of which the coils were formed partially contained precipitated fine crystals.

EXAMPLE 5

The procedure of Example 2 was repeated except that the composition of the thin strips was as given in Table 5. All of the thin strips partially contained precipitated fine crystals.

TABLE 5

| Coils | Composition | Pre-magnetization Characteristic | Secular Change |
|---|---|---|---|
| D-1 (Comparative Example) | $Fe_{75.5}Mn_{0.5}(Si_{0.646}B_{0.35}P_{0.004})_{24.0}$ s/q = 0 | 22 A | Δ |
| D-2 (Invention) | $Fe_{75.5}Mn_{0.5}(Si_{0.646}B_{0.317}P_{0.004}C_{0.033})_{24.0}$ s/q = 0.11 | 25 A | o |
| D-3 (Invention) | $Fe_{75.5}Mn_{0.5}(Si_{0.646}B_{0.271}P_{0.004}C_{0.079})_{24.0}$ s/q = 0.29 | 25 A | o |
| D-4 (Comparative Example) | $Fe_{75.5}Mn_{0.5}(Si_{0.646}B_{0.175}P_{0.004}C_{0.175})_{24.0}$ s/q = 1.0 | — | — |

The amount of heat generated in the coil D-4 was very great.

EXAMPLE 6

The procedure of Example 2 was repeated except that the composition of the thin strips was as given in Table 6.

All of the thin strips partially contained precipitated fine crystals.

TABLE 6

| Coils | Composition | Pre-magnetization Characteristic | Secular Change |
|---|---|---|---|
| E-1 (Comparative Example) | $Fe_{75.6}Mn_{0.4}(Si_{0.604}B_{0.329}C_{0.067})_{24.0}$ s/q = (0.2) | 26 A | Δ |
| E-2 (Invention) | $Fe_{75.6}Mn_{0.4}(Si_{0.604}B_{0.329}C_{0.063}P_{0.004})_{24.0}$ s/q = (0.19) | 26 A | o |
| E-3 (Invention) | $Fe_{75.6}Mn_{0.4}(Si_{0.604}B_{0.313}C_{0.042}P_{0.042})_{24.0}$ s/q = (0.13) | 24 A | o |
| E-4 (Comparative Example) | $Fe_{75.6}Mn_{0.4}(Si_{0.604}B_{0.25}C_{0.021}P_{0.125})_{24.0}$ s/q = (0.08) | 20 A | o |

EXAMPLE 7

The procedure of Example 2 was repeated except that the composition was $Fe_{77.7}Mn_{0.3}(Si_{0.5}B_{0.409}P_{0.005}C_{0.086})_{22}$ wherein the ratio s/q was 0.21. The coil produced is denoted by F in Table 7. For the purpose of comparison a laminated type core (core G) was manufactured using a part of the thin strip.

TABLE 7

| | Increase in Temperature |
|---|---|
| Coil F | 20° C. |
| Core G | 30° C. |

EXAMPLE 8

The procedure of Example 2 was repeated except for the thin strips having the composition as given in Table 8 was used.

TABLE 8

| Coils | Composition | Pre-magnetization Characteristic | Secular Change |
|---|---|---|---|
| H-1 (Invention) | $Fe_{76.5}Mn_{1}(Si_{0.6}B_{0.33}P_{0.03}C_{0.04})_{22.5}$ | 26 A | o |
| H-2 (Invention) | $Fe_{75.5}Co_{1}(Si_{0.6}B_{0.33}P_{0.03}C_{0.04})_{22.5}$ | 27 A | o |
| H-3 (Invention) | $Fe_{75.5}Cr_{1}(Si_{0.6}B_{0.33}P_{0.03}C_{0.04})_{22.5}$ | 26 A | o |
| H-4 (Invention) | $Fe_{75.5}Ni_{1}(Si_{0.6}B_{0.33}P_{0.03}C_{0.04})_{22.5}$ | 26 A | o |

In the present example, Fe of the coil H-1 was partly replaced with 1 atomic % of Co, Cr, or Ni. This partial replacement did not essentially change the pre-magnetization characteristic and the secular change.

We claim:

1. A core of a choke coil which consists of a coiled thin strip of an amorphous alloy, and has at least one cut air gap, the coiled regions of the thin strip being bound to one another at least in the neighborhood of said at least one cut air gap, and said amorphous magnetic alloy contains precipitated fine crystals and consist essentially of the following composition:

$$Fe_xMn_y(Si_pB_qP_rC_s)_z,$$

wherein x+y+z is 100 atomic % based on all of the elements, y is from 0.001 to 10 atomic %, z is from 21 to 25.5 atomic %, p+q+r+s is 1, p is from 0.40 to 0.75, r is from 0.0001 to 0.05, the ratio s/q is from 0.03 to 0.4, and z is $z \leqq 50p+1$, $z \leqq 10p+19$, $z \geqq 30p+2$, and $z \geqq 13p+13.7$.

2. A core of a choke coil according to claim 1, wherein z is from 22.5 to 24.5 atomic %, p is from 0.55 to 0.72, $z \leqq 10p+18$, $z \leqq -25p+42$, $z \geqq 50p-12$ and $z \geqq 10p+16$.

3. A core of a choke coil according to claim 1, wherein y is in the range of from 0.1 to 5 atomic %.

4. A core of a choke coil according to claim 1, wherein r is in the range of from 0.0001 to 0.01.

5. A core of a choke coil according to claim 1, wherein s is from 0.007 to 0.229.

6. A core of a choke coil according to claim 1, wherein q is from 0.143 to 0.571.

7. A core of a choke coil according to claim 1, wherein magnetic anisotropy is induced in the strip in a predetermined direction parallel to the sheet surface.

8. A core of a choke coil according to claim 1, wherein one-axis magnetic anisotropy is induced in the strip in a predetermined direction parallel to the sheet surface.

9. A core of a choke coil according to claim 1, wherein magnetic anisotropy is induced in a direction which is slanted with respect to the axial direction of a coiled thin strip of an amorphous magnetic alloy.

10. A core of a choke coil according to claim 1, wherein magnetic anisotropy is induced by heat treating said coiled thin strip of an amorphous magnetic alloy.

11. A core of a choke coil according to claim 1, wherein said precipitated fine crystals are formed by heat treatment of a completely vitrified thin strip of the amorphous alloy.

12. A core of a choke coil according to claim 1, wherein the core comprises core members, each of which consists of a thin strip of an amorphous magnetic alloy.

13. A core of a choke coil according to claim 1, wherein the core comprises core members, each of which consists of a thin strip of an amorphous magnetic alloy and each of which has a predetermined shape, formed by cutting a coiled thin strip of an amorphous magnetic alloy thin strip into shape.

* * * * *

UNITED STATES PATENT AND TRADEMARK OFFICE

CERTIFICATE OF CORRECTION

PATENT NO. : 4,587,507

DATED : May 6, 1986

INVENTOR(S) : Suguru TAKAYAMA et al

It is certified that error appears in the above-identified patent and that said Letters Patent is hereby corrected as shown below:

On the cover page, Item [30] should be deleted in its entirety.

Signed and Sealed this

*Twenty-third* Day of *September 1986*

[SEAL]

*Attest:*

DONALD J. QUIGG

*Attesting Officer* *Commissioner of Patents and Trademarks*